US009167866B2

(12) United States Patent
Neal

(10) Patent No.: US 9,167,866 B2
(45) Date of Patent: Oct. 27, 2015

(54) SHOE SOLE ORNAMENTATION APPARATUS AND RELATED METHOD

(76) Inventor: Nathan Y. Neal, Miami, FL (US)

( * ) Notice: Subject to any disclaimer, the term of this patent is extended or adjusted under 35 U.S.C. 154(b) by 527 days.

(21) Appl. No.: 13/571,922

(22) Filed: Aug. 10, 2012

(65) Prior Publication Data

US 2013/0042422 A1 Feb. 21, 2013

Related U.S. Application Data

(60) Provisional application No. 61/525,079, filed on Aug. 18, 2011.

(51) Int. Cl.

| | |
|---|---|
| ***A43B 13/12*** | (2006.01) |
| ***A43B 3/00*** | (2006.01) |
| ***A43D 5/04*** | (2006.01) |
| ***A43B 13/36*** | (2006.01) |
| ***A43B 13/22*** | (2006.01) |
| ***A43B 1/00*** | (2006.01) |
| ***A43B 13/04*** | (2006.01) |
| ***A43B 13/32*** | (2006.01) |
| ***A43C 13/00*** | (2006.01) |

(52) U.S. Cl.

CPC ..... *A43B 13/122* (2013.01); *A43B 1/0072* (2013.01); *A43B 3/0078* (2013.01); *A43B 13/04* (2013.01); *A43B 13/22* (2013.01); *A43B 13/32* (2013.01); *A43B 13/36* (2013.01); *A43C 13/00* (2013.01); *A43D 5/04* (2013.01); *Y10T 83/0405* (2015.04); *Y10T 83/929* (2015.04)

(58) Field of Classification Search

CPC ..... A43B 3/0078; A43B 13/04; A43B 13/32; A43B 13/122; A43B 13/36; A43B 13/22; A43C 13/00; A43C 13/08; A43D 5/04; A43D 5/00

USPC ..... 36/15; 12/103

See application file for complete search history.

(56) References Cited

U.S. PATENT DOCUMENTS

| | | | | | |
|---|---|---|---|---|---|
| 557,887 | A * | 4/1896 | Robertson | A01G 3/06 | 30/165 |
| 791,393 | A * | 5/1905 | Abbott | A01G 3/06 | 294/50.6 |
| 1,637,450 | A * | 8/1927 | Martin | 12/103 | |
| 1,642,390 | A * | 9/1927 | Tekker | E04D 15/04 | 254/26 R |
| 1,662,756 | A * | 3/1928 | Montante | 36/32 R | |
| 1,931,773 | A * | 10/1933 | Sobol | A01B 1/16 | 294/50.6 |
| 2,010,009 | A * | 8/1935 | Brightwell | D05B 81/00 | 30/315 |
| 2,041,179 | A * | 5/1936 | Higbee | A01G 1/12 | 172/13 |
| 2,110,249 | A * | 3/1938 | Walker | 12/146 R | |
| 2,134,196 | A * | 10/1938 | Miller | 36/72 C | |
| 2,621,405 | A * | 12/1952 | Facciuto | A43D 5/04 | 12/103 |
| 2,972,035 | A * | 2/1961 | Miller | B26F 3/06 | 30/140 |
| 3,693,269 | A * | 9/1972 | Guarrera | 36/15 | |
| 3,918,158 | A * | 11/1975 | Debski | B26B 3/08 | 30/314 |
| 4,862,591 | A * | 9/1989 | Barringer | A01K 97/01 | 30/164.8 |
| 5,771,605 | A * | 6/1998 | Safdie | 36/25 R | |
| 6,640,465 | B1 * | 11/2003 | Burgess | 36/15 | |

(Continued)

*Primary Examiner* — Ted Kavanaugh

(74) *Attorney, Agent, or Firm* — Allen Dyer Doppelt Milbrath & Gilchrist

(57) ABSTRACT

The present invention is directed toward a device, kit, and related method for an adhesive film for application to the sole of a shoe. More specifically, the film is easily attached to the shoe sole so that a user may decorate their shoe soles and continuously change the appearance of the soles of a single pair of shoes instead of purchasing multiple shoes of a variety of styles. It also serves as a shoe sole protector, as it covers the original sole protecting it from wear and abrasion. A cutting device to trim the film to size without trimming the shoe material is also contemplated.

11 Claims, 8 Drawing Sheets

(56) References Cited

U.S. PATENT DOCUMENTS 8,468,719 B2 * 6/2013 Dvorak ..... A43B 3/0078 36/136

2005/0274043 A1 * 12/2005 DeSaix ..... A43B 1/0027 36/59 R

* cited by examiner

SHOE SOLE ORNAMENTATION APPARATUS AND RELATED METHOD

CROSS-REFERENCE TO RELATED APPLICATION

This application claims priority from U.S. Provisional Patent Application Ser. No. 61/525,079 filed on Aug. 18, 2011 entitled "Interchangeable Sole Ornamentation. Kit and Method," the contents of which are incorporated by reference herein.

FIELD OF THE INVENTION

The present invention relates to the field of shoe accessories and, more particularly, to shoe sole ornamentation apparatuses, kits, and related methods.

BACKGROUND OF THE INVENTION

Shoes, and particularly women's shoes, are more than foot protection, and are typically regarded as fashion accessories. When consumers buy shoes, especially high-heeled varieties, women are typically concerned not only with comfort and durability, but also with shoe aesthetics, how the shoes comport with fashion trends, and clothing compatibility. Because the shoe is regarded as a particularly important fashion accessory, consumers often buy numerous pairs of shoes to match a variety of outfits.

Like other forms of fashionable apparel, trendy shoes can be extremely expensive, and particularly so if made by a famous designer. Because such shoes are typically designed with style and fashion in mind—and not necessarily comfort or longevity—it is not uncommon for the sole of a woman's shoes to show wear after a relatively short period of time. Women's shoes may wear particularly badly from repeated exposure to rough surfaces such as asphalt or pavement. The combination of the desire for new, fashionable shoes and the fact that such shoes may wear somewhat quickly results in a huge market for women's shoes. In 2007, for example, the U.S. consumed over 950 million pairs of women's shoes (non-rubber). Meanwhile, the U.S. only consumed approximately 240 million pairs of men's shoes in the same time frame.

There is a need in the art of women's shoes for a means to allow easy attachment and removal of ornamentation to the sole of any woman's shoe, which is particularly difficult for high heels with severe and complex curvatures.

SUMMARY

In view of the foregoing background, it is therefore an object of the present invention to provide an apparatus, related and related methods to allow easy attachment and removal of ornamentation to the sole of a shoe.

It is an object of the present invention to provide an apparatus, related and related methods which allows easy attachment and removal of ornamentation the sole of a high-heel shoe having severe and complex curvatures.

It is an object of the present invention to provide these apparatus, related kit, and related methods without the need for screws or other alterations to the sole. Further, such designs should be flexible to accommodate the spectrum of sole contours present across the various styles of women's shoes. Further, such an invention should provide protection to increase the longevity of the shoe sole.

This and other objects, features, and advantages in accordance with the present invention are provided by a shoe sole film applicator kit comprising a piece of adhesive film for application to a shoe sole. An applicator is provided for applying the adhesive film to the shoe sole. In one embodiment, the applicator is a flexible squeegee.

Additionally, a cutting device is used to cu the adhesive film into a shape and dimension that is substantially coextensive with the shoe sole.

The cutting device is a razor blade or a device comprising a V-shaped notch, the notch having a beveled cutting edge.

In one embodiment, the adhesive film is a vinyl film, and preferably polyvinyl chloride, and is about 1.5 to about 12 mils thick. The adhesive film also comprises an acrylic pressure-sensitive adhesive. In a related embodiment, the adhesive film comprises a clear overlaminate that is about 3 to about 20 mils.

The invention also contemplates a method of applying film to a shoe sole comprising the steps of: providing an adhesive film for the application to a shoe sole; providing an applicator designed for applying the adhesive film to the shoe sole; and providing a cutting device designed for cutting the adhesive film applied to the shoe sole. Related embodiments of the method include at least one of the steps of: applying an adhesive film to a sole of a shoe; cutting the adhesive film into a shape that is substantially coextensive with the sole of the shoe; using an edge of the sole as a guide to cut the adhesive film; and heating the adhesive film.

The cutting device contemplated for cutting adhesive film using an edge as a guide comprises a handle having a size and dimension to be held between a user's thumb and index finger. It comprises a curved surface extending from the handle, the curved surface defining a v-shaped notch and a doubly beveled knife edge along the edge of the notch. The notch is between about 3 mm and about 20 mm in depth, and the bevel is asymmetric in one embodiment.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF THE PREFERRED EMBODIMENTS

In the Summary of Invention above and in the Detailed Description of the invention and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

The term "comprises" is used herein to mean that other ingredients, elements, steps, etc. are optionally present. When reference is made herein to a method comprising two or more defined steps, the steps can be carried in any order or simultaneously (except where the context excludes that possibility), and the method can include one or more steps which are carried out before any of the defined steps, between two of the defined steps, or after all of the defined steps (except where the context excludes that possibility).

In this section, the present invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art.

The Kit

FIGS. 1-5 illustrate the contents of a kit for applying an adhesive film to the bottom a shoe. The kit contains adhesive film 10, an applicator 30, and a cutting device 40.

Figure 1:
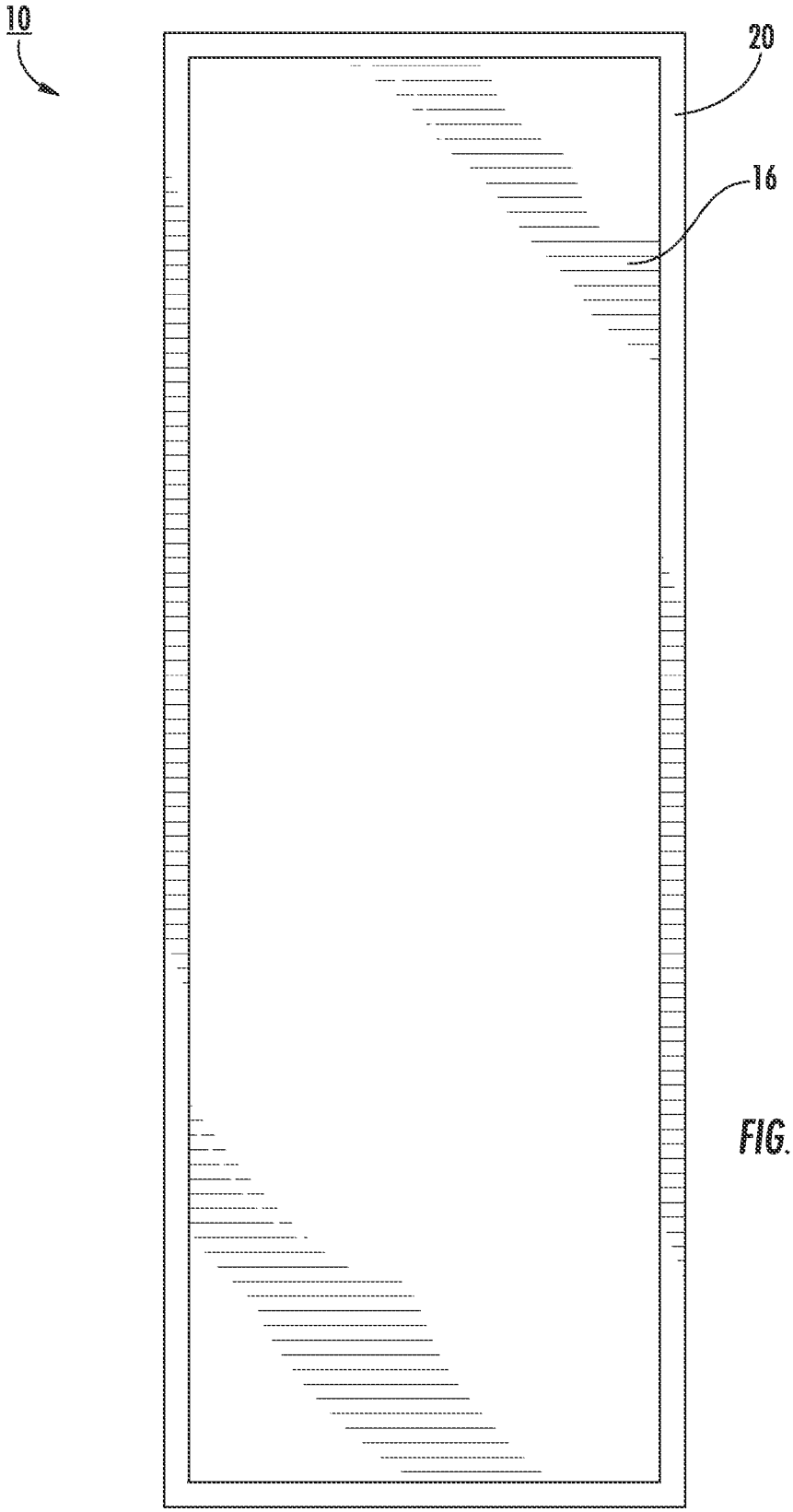
FIG. 1 illustrates an embodiment of an adhesive film.
Figure 2:
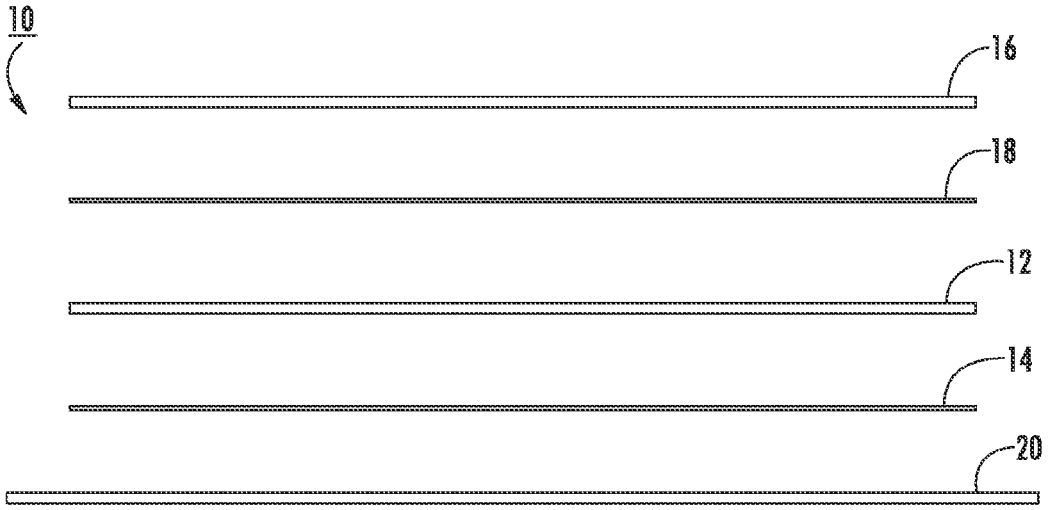
FIG. 2 illustrates a cross section of the adhesive film of FIG. 1.

FIGS. 1 and 2 illustrate a sheet of adhesive film 10. The adhesive film 10 comprises a polymer layer 12. The polymer layer is a vinyl polymer, though polyethylene, polypropylene, and any other polymeric film is contemplated. In a preferred embodiment, the polymer layer 12 is composed of monomeric polyvinyl chloride. The polymer layer 12 is about 1.5 mils to 18 mils in thickness, with a preferred thickness of about 3 mils. The adhesive film 10 comprises a layer of adhesive 14. The adhesive 14 is a double-sided tape, liquid adhesive, or any other adhesive known in the art. In a preferred embodiment, the layer of adhesive 14 is an acrylic pressure-sensitive adhesive. The acrylic pressure-sensitive adhesive is between about 0.4 mils to 1.8 mils, and preferably between about 0.8 mils to 1.1 mils.

In one embodiment, a clear overlaminate 16 is attached to the surface of the adhesive film 10. The overlaminate 16 is a clear polymeric film. In a preferred embodiment, the overlaminate 16 is a clear flexible polyvinyl chloride. The overlaminate 16 is about 3 mils to 20 mils in thickness, with a preferred thickness of about 12 mils. The clear overlaminate 16 is attached to the adhesive film with a layer of adhesive 18.

A liner 20 provides a substrate for the adhesive film 10 to attach to for transport and storage. Before the adhesive film 10 is attached to a shoe 50 (FIG. 5), the film 10 is first removed from the liner 20. In one embodiment, the liner is a polyethylene-coated release paper. In a preferred embodiment, the liner 20 is 90# Sta-Flat liner.

The adhesive film 10 is preferably colored. In other embodiments, the adhesive film 10 contains patterns, logos, photographs, and/or images. For example, a sports teams color with associated logo and graphics may adorn the adhesive film 10.

Figure 3:
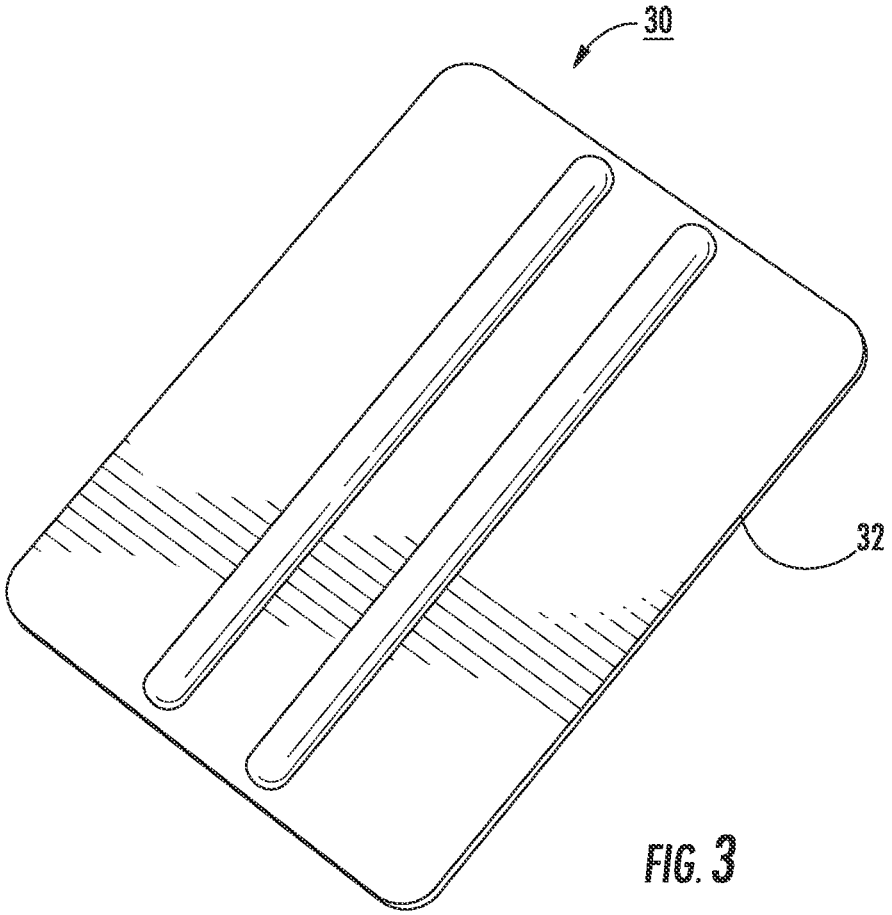
FIG. 3 illustrates an embodiment of an applicator.

FIG. 3 illustrates an applicator 30. In a preferred embodiment the applicator is a plastic, rubber, or polymer squeegee-type applicator. However, the squeegee can be metal, wood, silicone, composite, plastic, rubber, polymer, felt, and combinations thereof. The applicator 30 comprises an edge 32 that is used to apply even and concentrated pressure to the adhesive film 10 upon application to a shoe 62. The applicator 30 comprises straight and/or curved edges. In one embodiment of the invention, low friction sleeve is placed over the applicator 30 to facilitate application of the adhesive film 10 upon application to a shoe 62.

Figure 4:
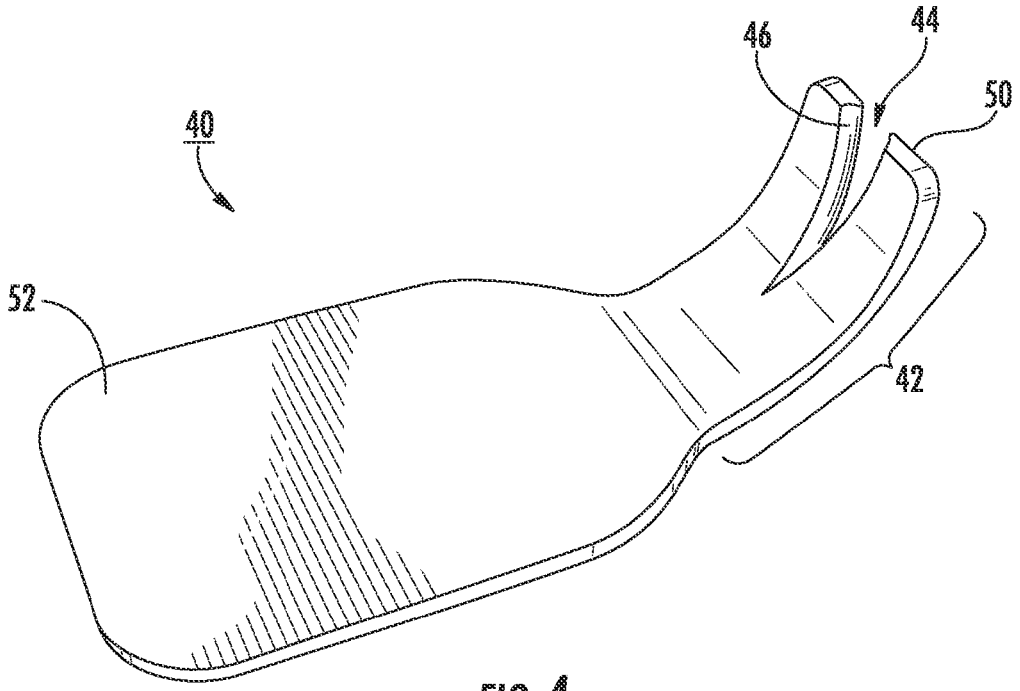
FIG. 4 illustrates an embodiment of a cutting device.
Figure 5:
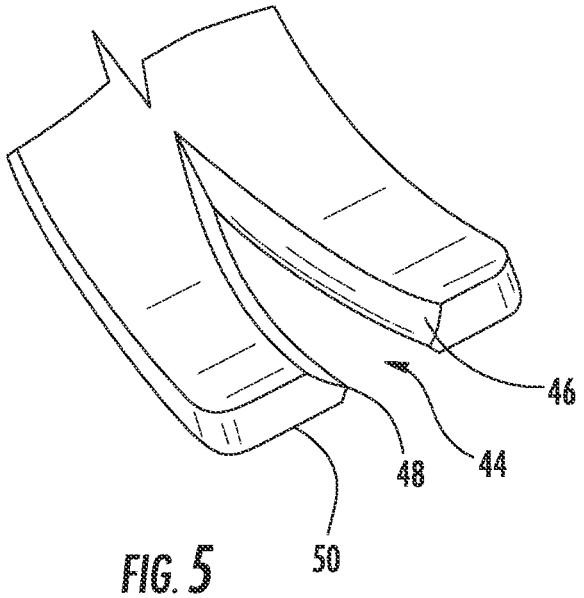
FIG. 5 illustrates a close-up view of the V-notch of the cutting device in FIG. 4.

FIGS. 4 and 5 illustrate an embodiment of the cutting device 40. The cutting device 40 is used to trim adhesive film 10 after application to a shoe 62. A razor blade is contemplated by the invention, but a preferred embodiment is a device comprising a curved surface 42 that defines a beveled. V-notch 44. The V-notch 44 is between about 3 mm and 20 mm in depth. In one embodiment, the notch comprises a double bevel 46. The double bevel 46 forms a sharp cutting edge 48 to slice adhesive film 10. The double bevel 46 also acts to offset the cutting edge 48 away from the bottom surface 50 of the cutting device 40 to reduce the chance of cutting material from the shoe itself when trimming adhesive film 10. The cutting device 40, in one embodiment, comprises a handle 52. The radius of the curved surface is between about 0.375 inches and 0.625 inches, with a preferred radius of about 0.5 inches.

A kit comprising adhesive film 10, an applicator 30, and a cutting device 40 is contemplated by the invention. The kit provides adhesive film 10 for application to the sole of a shoe 62. This allows a user of the kit to change the appearance of the sole of a shoe 62 based upon the appearance of the adhesive film 10. To facilitate application of the adhesive film 10, an applicator is provided. The applicator is used to reduce/eliminate air bubbles from forming between the adhesive film 10 and the shoe 62. Once the film 10 is applied, the cutting device 40 is used to cut the film 10 so that the film 10 follows the contour of the sole of the shoe 62.

Method of Applying Film to a Shoe Sole

Figure 6:
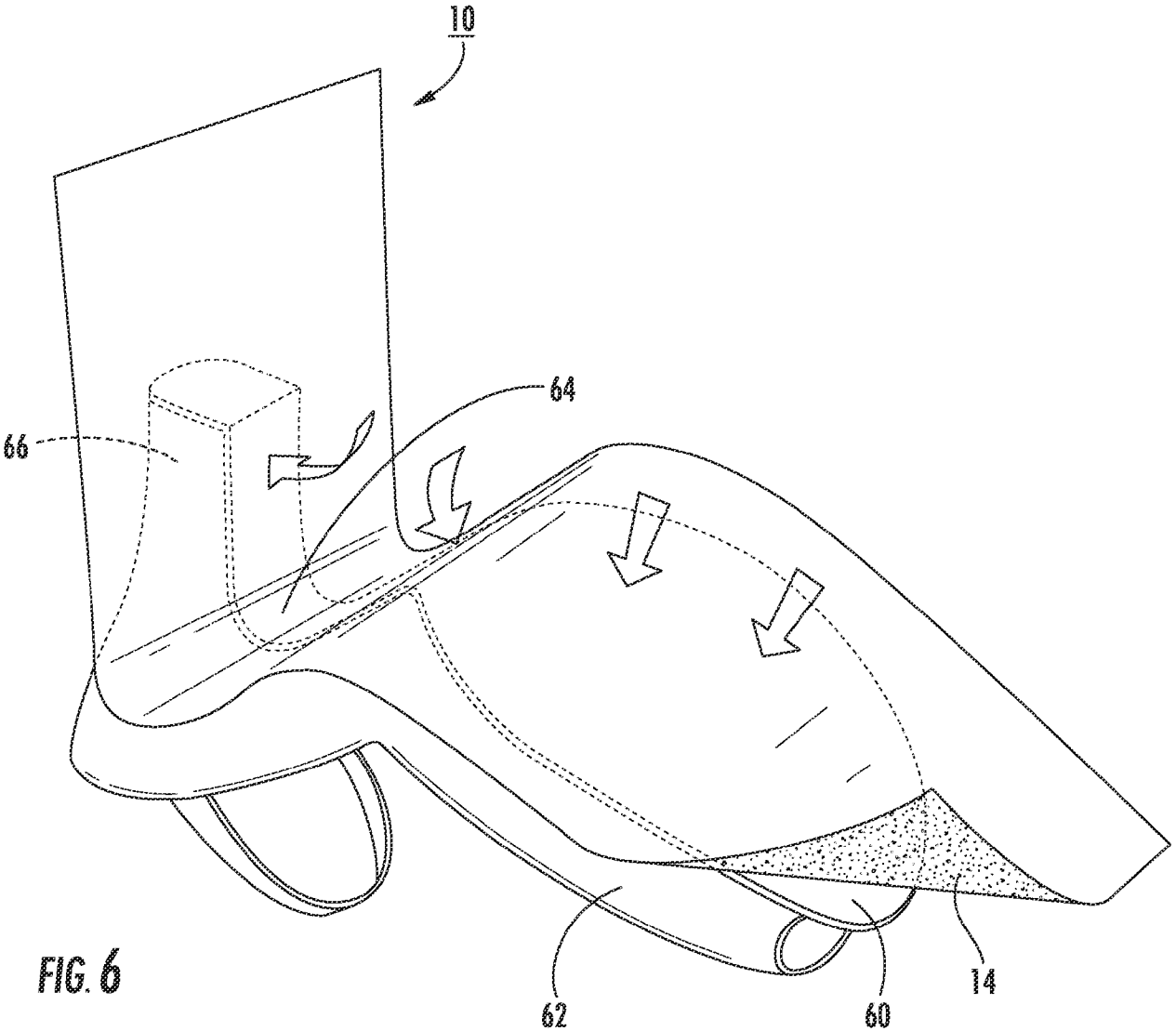
FIG. 6 illustrates an adhesive film being applied to the sole of a shoe.

Turning initially to FIG. 6, the invention contemplates a method for applying an adhesive film 10 to the sole 60 of a shoe 62. The film 10 applied for ornamentation and/or protective purposes. The adhesive film 10 is removed from the liner 20, and placed on sole 60 of a shoe 62. Preferably, the sole 60 of a shoe 62 is cleaned and dried before the film 10 is applied. The adhesive 14 attaches the film's 10 polymer layer 12 to the sole 60 of a shoe 62.

Figure 7:
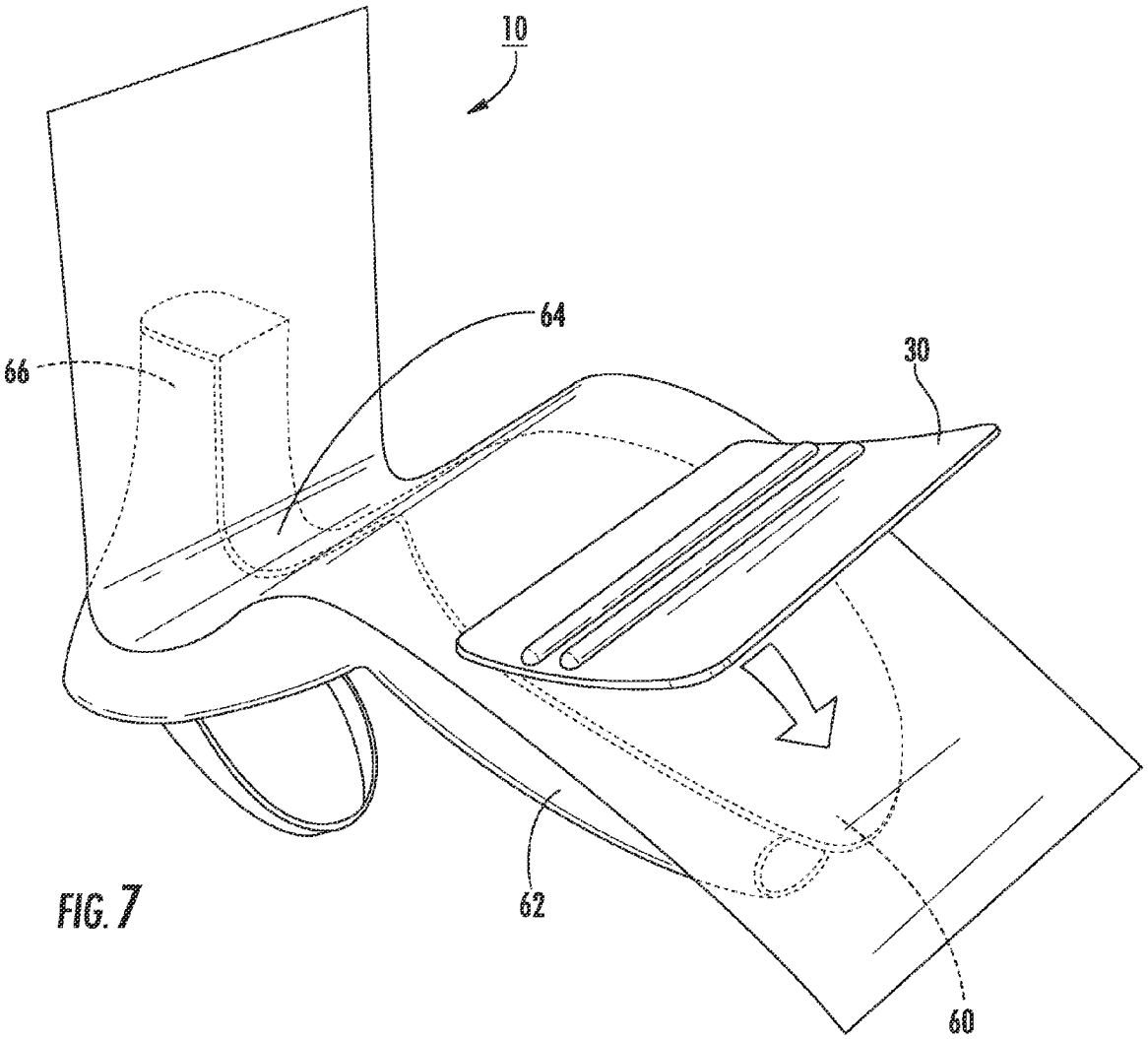
FIG. 7 illustrates an adhesive film being applied to the sole of a shoe with an applicator.

To promote adhesion, as illustrated in FIG. 7, an applicator 30 is used to smooth and press the film 10 to the sole 60. This aids in adhesion, removal of air bubbles/pockets that may form between the film 10 and the sole 60, as well as to promote contact between the film 10 and the sole 60 in difficult-to-reach areas of the shoe 62 such as the transition area 64 where the sole 60 transitions into the heel 66. Misting the film 10 with water reduces friction and the likelihood of scratching the film 10 with the applicator 30. Additionally, applying heat, as from a conventional hairdryer, makes the film 10 more pliable, and will aid in application of the film 10 to the sole 60.

Figure 8:
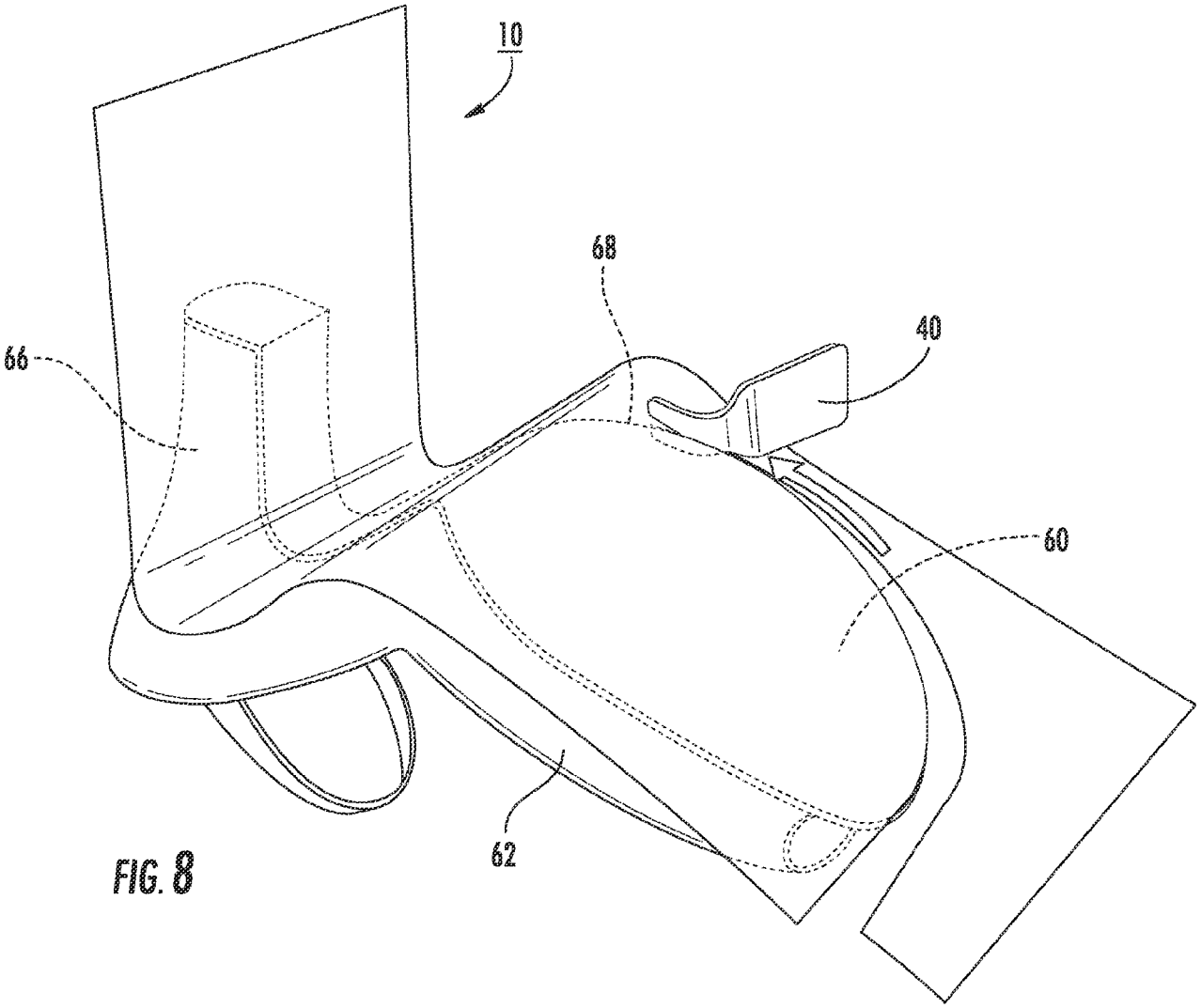
FIG. 8 illustrates an adhesive, film being trimmed to sole substantially coextensive with the sole of a shoe.
Figure 9:
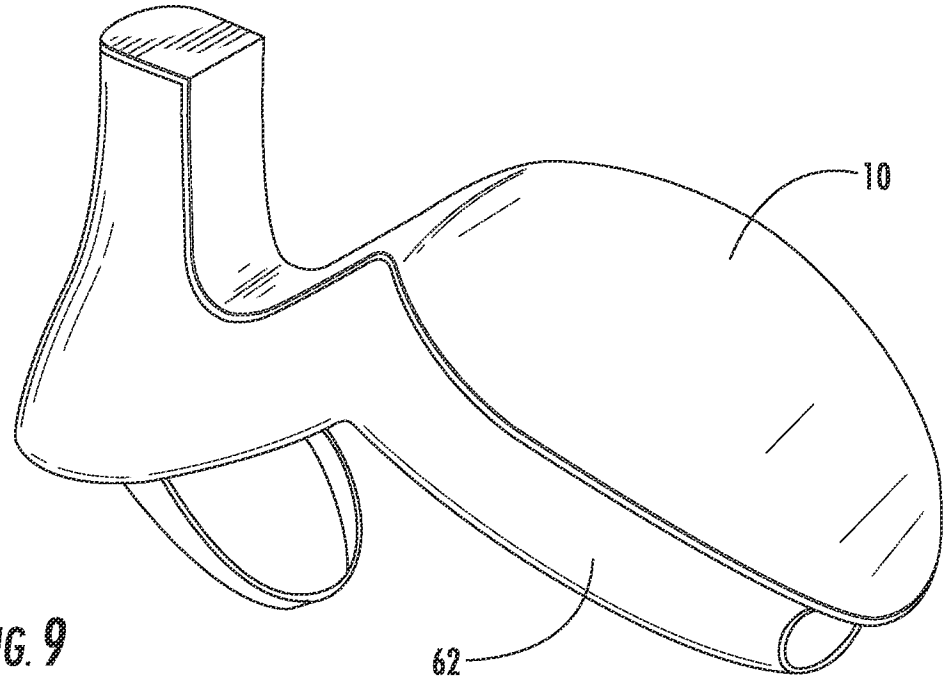
FIG. 9 illustrates an adhesive film applied to the sole of a shoe after the film, is trimmed to size.

FIG. 8 illustrates the step of cutting the film 10 into a shape that is substantially coextensive with the sole 60. The cutting device 40 is used by engaging the film 10 with the cutting edge 48 to slice the film 10. The edge 68 of the sole is used as a guide whereupon the bottom surface 58 of the cutting device 40 rests. The cutting device 40 is used by following the edge 68 around the entire sole 60 until the film 10 is cut to be substantially coextensive with the sole 60. FIG. 9 illustrates the film 10 after it has been but by the cutting device 30.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A method of applying film to a shoe sole comprising the steps of:

providing an adhesive film for application to a shoe sole having a sole edge, wherein the adhesive film comprises a polymer layer and a clear overlaminate layer, and the polymer layer comprises one or more of patterns, logos, photographs, and images;

applying the adhesive film to the shoe sole; and trimming the adhesive film extending from the sole edge with a cutting device so that the adhesive film is substantially coextensive with the sole of the shoe.

2. The method of applying film to a sole of a shoe of claim 1 wherein an applicator is used to apply the adhesive film to the shoe sole.

3. The method of applying film to a sole of a shoe of claim 1, further comprising the step of using an edge of the sole as a guide to cut the adhesive film.

4. The method of applying film to a sole of a shoe of claim 1, further comprising the step of heating the adhesive film.

5. The method of applying film to a sole of a shoe of claim 1 wherein the polymer layer of the adhesive film is colored.

6. The method of applying film to a sole of a shoe of claim 1 wherein the cutting device comprises a curved surface defining a v-shaped notch; and a doubly beveled knife edge along the edge of the notch.

7. The method of applying film to a sole of a shoe of claim 6 wherein the notch is between about 3 mm and about 20 mm in depth.

8. The method of applying film to a sole of a shoe of claim 6 wherein the curved surface comprises a radius between about 0.375 inches and 0.625 inches.

9. The method of applying film to a sole of a shoe of claim 1 wherein the overlaminate layer comprises polyvinyl chloride.

10. The method of applying film to a sole of a shoe of claim 1 wherein the polymer layer is applied to the shoe sole via acrylic pressure-sensitive adhesive.

11. The method of applying film to a sole of a shoe of claim 1 wherein the polymer layer is applied to the shoe sole via a double-sided tape.

* * * * *